US006003344A

United States Patent [19]

Castaño

[11] Patent Number: 6,003,344

[45] Date of Patent: Dec. 21, 1999

[54] KNITTED FABRIC WITH PARTIALLY UNRAVELED STITCHES

[76] Inventor: Ignasi Claret Castaño, Calle de la Salut No. 47, Terrassa, Spain

[21] Appl. No.: 08/935,226

[22] Filed: Sep. 22, 1997

[51] Int. Cl.[6] ..... D04B 1/00

[52] U.S. Cl. ..... 66/169 R

[58] Field of Search ..... 66/1 R, 169 R, 66/170, 171, 172 R, 173, 172 E, 179, 202, 169 A; 442/312, 713

[56] References Cited

U.S. PATENT DOCUMENTS 868,822 10/1907 Swinglehurst ..... 66/169 A
1,833,705 11/1931 Botts ..... 66/172 R
2,190,409 2/1940 Maier ..... 66/169 A
3,059,456 10/1962 Brooke ..... 66/172 R
3,392,552 7/1968 Muller et al. ..... 66/169 R

*Primary Examiner*—John J. Calvert
*Assistant Examiner*—Larry D. Worrell, Jr.
*Attorney, Agent, or Firm*—Horst M. Kasper

[57] ABSTRACT

A knitted fabric presents one or more passage courses formed by a removable support thread which, upon being removed, allows the partial unraveling of a zone of said knitted fabric, and increases the width of the mesh or stitch in said zone.

19 Claims, 2 Drawing Sheets

KNITTED FABRIC WITH PARTIALLY UNRAVELED STITCHES

BACKGROUND OF THE INVENTION

1. Field of the Invention

The present invention relates to a knitted fabric which presents one or more passage courses formed by a removable support thread which, upon being removed, allows the partial unraveling of a zone of said knitted fabric, and which increases the width of the mesh or stitch in said zone.

2. Brief Description of the Background of the Invention Including Prior Art

There is no record known to the applicant with respect to the existence of knitted fabrics which consider the possibility of allowing its partial and controlled demeshing, undoing, unraveling, and unstitching and which can be manufactured without additional manufacturing costs.

SUMMARY OF THE INVENTION

1. Purposes of the Invention

It is a goal of the present invention to furnish and manufacture knitwear to manufacture knitted fabrics having novel and attractive characteristics for the consumer which might be achieved by way of a change of the pattern, of the design, of the combinations of colors, of the types of knitting, and of combinations of the aforesaid characteristics.

These and other objects and advantages of the present invention will become evident from the description which follows.

2. Brief Description of the Invention

The present invention provides for a knitted fabric capable of being partly unraveled. A previous course of the knitted fabric has previous stitches. A first course is made with a support thread. The support thread comes to form part of a knitted fabric at alternate stitches. A next following course has next following stitches. The previous stitches of the previous course and the next following stitches of the next following course are united with the support thread.

The previous stitches of the previous course and the next following stitches of the next following course can be united with the support thread by way of the stitches formed by the support thread itself or, alternatively, the previous stitches of the previous course and the next following stitches of the next following course can be united with the support thread directly between the stitches themselves.

The first course can be made in part with the support thread or the first course can be made in totality with the support thread.

The stitches of the previous course, which are directly fastened to those stitches of the next following course and which remain between the stitches defined by the support thread, can have a larger length than a balance of the stitches forming the knitted fabric.

Ends of the support thread can remain unfastened and visible in order to allow a removal of the support thread and a freeing of the alternate stitches fastened by the support thread.

The knitted fabric which is the subject matter of the present invention presents a novel characteristic comprising a knitted fabric including a support thread at least in one of the courses and over the total or partial length of the courses, which support thread comes to form a part of the knitted fabric only in alternate stitches such that the stitches of the previous course, wherein the support thread does not engage into said stitches, remain held by the stitches of the following course to the course previously formed with the support thread.

The course or courses made with the support thread are features of the present invention and can be applied also to knitted fabrics having a structure of one or two front sides.

According to the invention, the support thread itself can be the same type of thread as the support thread used for making the remainder of the knitted fabric or can be a different thread; in either one of the cases the ends of the support thread remain free and unfastened and visible.

This feature allows that the support thread or the support threads can be removed by pulling at the visible ends such that there is achieved the freeing of those alternate stitches which were held by the support thread.

Once the support threads have been removed, the knitted fabric can be partially unraveled, undone, demeshed, and unstitched upon stretching in every direction such that the stitches of these wales in which the support threads engage become unfastened and the length of the thread employed in said stitches is taken over by the stitches of the neighboring wales, in which the support thread does not engage, such that there is obtained a widening, stretching, and enlarging of the mesh defined by the stitches.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
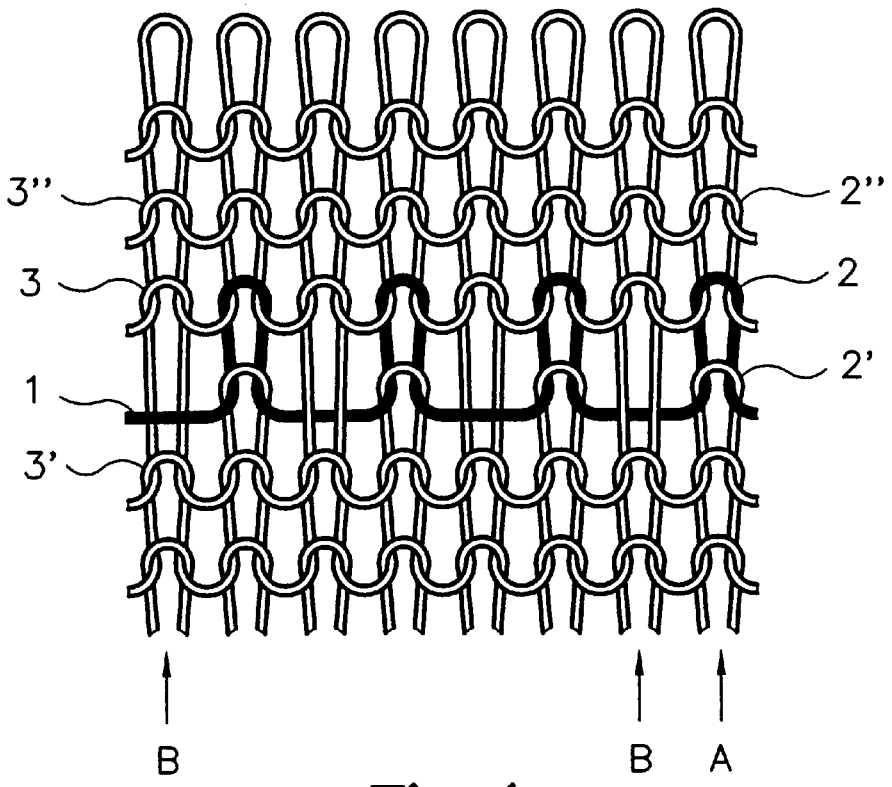
FIG. 1 shows a view of a portion of the knitted fabric which is the subject matter of the invention with a structure on one side.

The knitted fabric shown in FIG. 1 includes in one of the courses a support thread 1 with which stitches 2 are formed. The stitches 2 connect in alternating corresponding wales "A" the stitches 2' of the previous course to the stitches 2" of the following course, respectively, for forming the course of said support thread 1.

Some stitches 3 are disposed in the wales "B" of stitches between the stitches 2, wherein the stitches 3 connect to the lower stitches 3' and to the upper stitches 3", and wherein the stitches 3 have a length larger than the balance of the stitches forming the knitted fabric.

Figure 3:
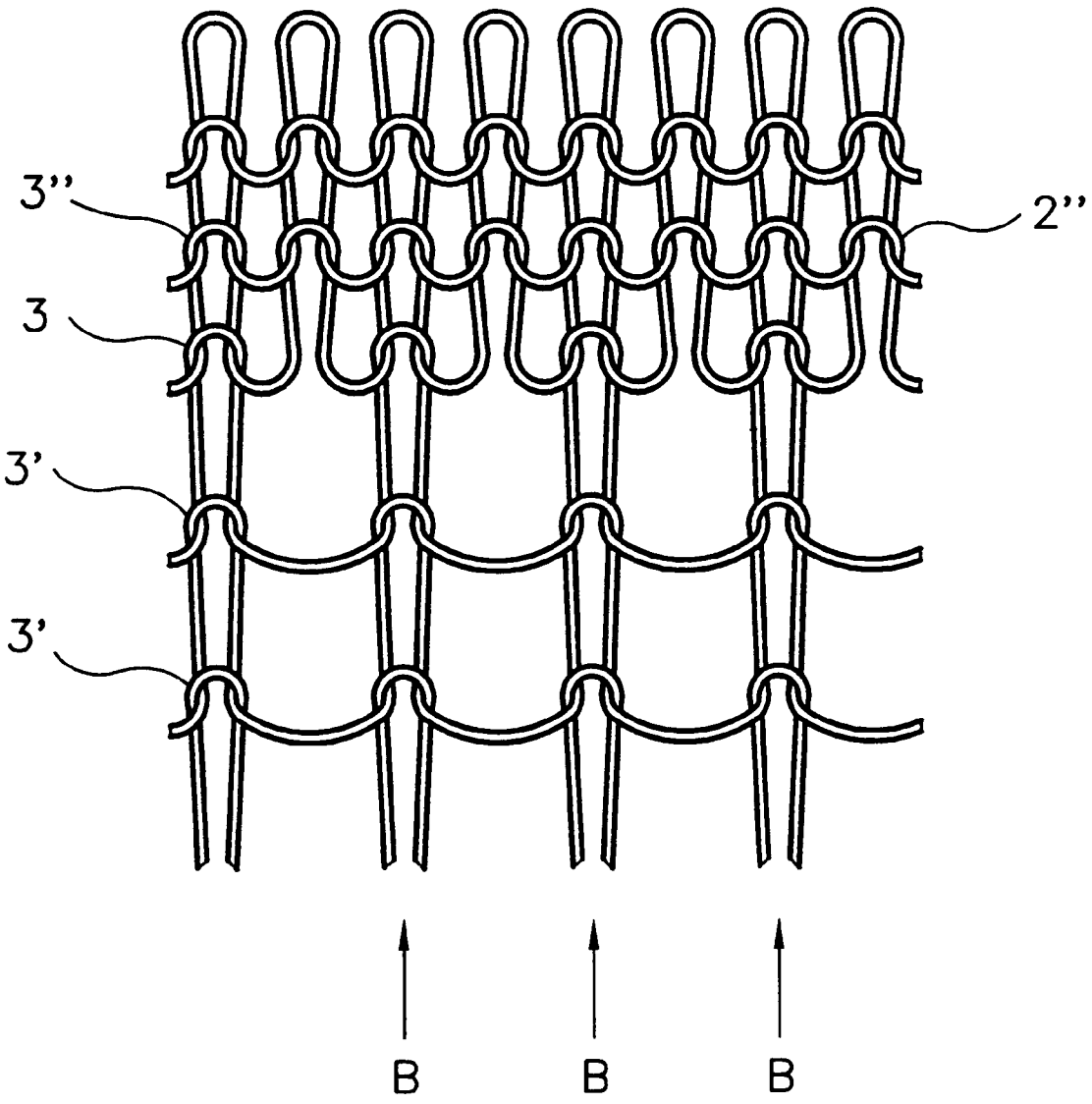
FIG. 3 shows a view of a portion of the knitted fabric of FIG. 1 once partially unraveled.

In order to produce the partially demeshed and unraveled knitted fabric, it is sufficient to remove the support thread 2, whereby the stitches 2' of the wales "A" become free and unfastened and, when stretching or pulling the knitted fabric in any direction, said stitches 2' will become unraveled and are absorbed in their length by the stitches 3' of the wales "B" in such a way that the width of the mesh, defined by the knitted fabric starting from the position initially occupied by the support thread 1, increases, as one observes in FIG. 3.

Figure 2:
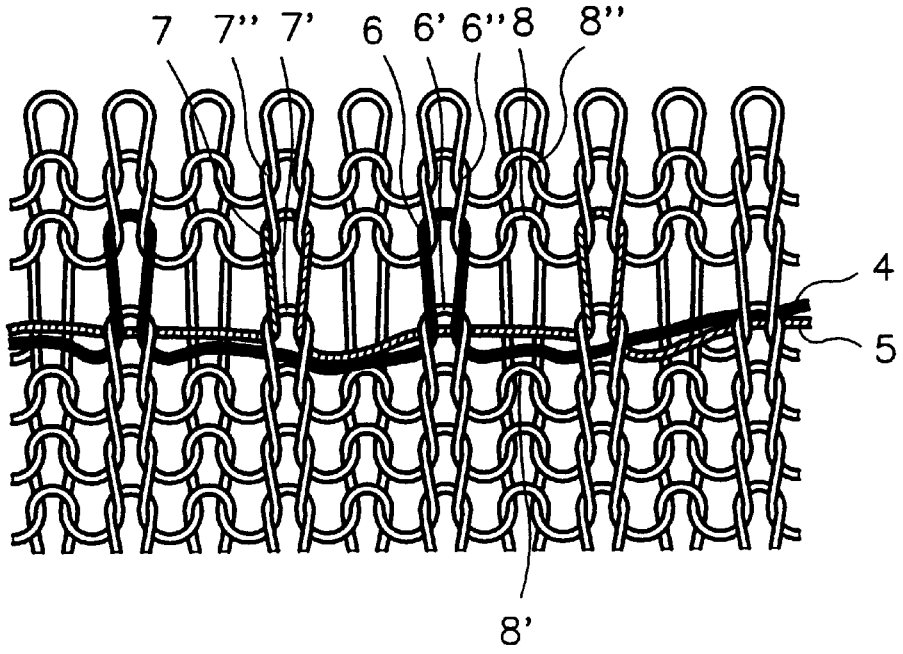
FIG. 2 shows a view of a portion of the knitted fabric which is the subject matter of the invention with a structure on two sides.

The same effect is obtained in the knitted fabric with the structure of two front sides, illustrated in FIG. 2, wherein said knitted fabric, in contrast to the previous example, includes two support threads 4 and 5, with which the stitches 6 and 7, respectively, are formed.

The stitches 6 and 7 alternate among each other and with the intermediate stitches 8 of a larger length, connecting the stitches 6' and 6" and the stitches 7' and 7" of the previous course and of the next following course, respectively.

The intermediate stitches 8 connect the stitches 8' and 8" of the previous course and of the following course to the stitch made with the support threads.

According to this embodiment, when the support threads 4 and 5 are extracted or removed, the lower stitches 6' and 7' are freed having obtained the length of the thread, which thread matches the stitches 8', thus starting a stretching and a widening of the mesh defined by the knitted fabric similarly as in the previous example.

It is not believed necessary to further expand on this description, for any person skilled in the art of this field understands the advance of the invention and the advantages which are derived from the invention.

The terms and words which are used in this description have always to be taken in a wide sense and not in a limiting sense.

The materials, the form, the size, and the location of the elements of the invention are subject to variation as long as it does not change the characteristics of the invention which is claimed in the following.

It will be understood that each of the elements described above, or two or more together, may also find a useful application in other types of knitted fabrics differing from the types described above.

While the invention has been illustrated and described as embodied in the context of a knitted fabric with partially unraveled stitches, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A knitted fabric capable of being partly unraveled comprising a previous course having previous stitches;

a first course made with two support threads, wherein the support threads come to form part of the knitted fabric at alternate stitches, a next following course having next following stitches, wherein the previous stitches of the previous course and the next following stitches of the next following course are united with the two support threads.

2. The knitted fabric according to claim 1, wherein the previous stitches of the previous course and the next following stitches of the next following course are united with the two support threads by way of the stitches formed by the two support threads.

3. The knitted fabric according to claim 1, wherein the previous stitches of the previous course and the next following stitches of the next following course are united with the support thread directly between the previous stitches and the next following stitches.

4. The knitted fabric according to claim 1, wherein the first course is made in part with the two support threads.

5. The knitted fabric according to claim 1, wherein the first course is made in totality with the two support threads.

6. The knitted fabric according to claim 1, wherein the stitches of the previous course, which are directly fastened to those stitches of the next following course and which remain between the stitches defined by the two support threads, have a larger length than a balance of the stitches forming the knitted fabric.

7. The knitted fabric according to claim 1, wherein ends of the two support threads remain unfastened and visible in order to allow a removal of the two support threads and a freeing of the alternate stitches fastened by the two support threads.

8. A knitted fabric capable of being partly unraveled, wherein at least one course is made in part or in totality with two support threads, wherein the two support threads come to form part of the knitted fabric at alternate stitches, wherein the stitches of the previous course and the stitches of the next following course are united with the two support threads by way of the stitches formed by the two support threads or directly between the stitches of the previous course and the stitches of the next following course.

9. The knitted fabric according to claim 8, wherein the stitches of the previous course, which are directly fastened to those stitches of the following course and which remain between the stitches defined by the two support threads, have a larger length than the balance of the stitches forming the knitted fabric.

10. The knitted fabric according to claim 8, wherein the ends of the two support threads remain unfastened and visible in order to allow their removal and the freeing of the alternate stitches fastened by the support threads.

11. A knitted fabric capable of being partly unraveled comprising a previous course having previous stitches;

a first course made with a first support thread, wherein the first support thread comes to form part of the knitted fabric at every fourth one of the previous stitches, and a second support thread, wherein the support thread comes to form part of the knitted fabric at every fourth one of the previous stitches, and wherein the second support threads are disposed at a location between the positions of the first support threads;

a next following course having next following stitches, wherein the previous stitches of the previous course and the next following stitches of the next following course are united with the support thread.

12. The knitted fabric according to claim 11, wherein the second support thread is disposed at a location centered between the positions of the first support thread.

13. The knitted fabric according to claim 12, wherein the previous stitches of the previous course and the next following stitches of the next following course are united with the support thread by way of the stitches formed by the support thread itself.

14. The knitted fabric according to claim 11, wherein the previous stitches of the previous course and the next following stitches of the next following course are united with the support thread directly between the previous stitches and the next following stitches.

15. The knitted fabric according to claim 12, wherein the stitches of the previous course, which are directly fastened to those stitches of the next following course are located between the positions of the first support thread and the positions of the second support thread.

16. The knitted fabric according to claim 15, wherein the stitches of the previous course, which are directly fastened to those stitches of the next following course are assuming all available remaining positions between the positions of the first support thread and the positions of the second support thread.

17. The knitted fabric according to claim 16, wherein the stitches of the previous course, which are directly fastened to those stitches of the next following course and which are located between the stitches defined by the first support thread and the second support thread, have a larger length than a balance of the stitches forming the knitted fabric.

18. The knitted fabric according to claim 17, wherein ends of the first support thread remain unfastened and visible in order to allow a removal of the first support thread and a freeing of the alternate stitches fastened by the support thread.

19. The knitted fabric according to claim 18, wherein ends of the second support thread remain unfastened and visible in order to allow a removal of the second support thread and a freeing of the alternate stitches fastened by the support thread.

* * * * *